US007777710B2

(12) United States Patent
Osame

(10) Patent No.: US 7,777,710 B2
(45) Date of Patent: Aug. 17, 2010

(54) DISPLAY DEVICE

(75) Inventor: Mitsuaki Osame, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 827 days.

(21) Appl. No.: 11/652,282

(22) Filed: Jan. 11, 2007

(65) Prior Publication Data

US 2007/0164967 A1 Jul. 19, 2007

(30) Foreign Application Priority Data

Jan. 13, 2006 (JP) ..... 2006-005592

(51) Int. Cl.
*G09G 3/36* (2006.01)

(52) U.S. Cl. ..... 345/98; 345/76; 345/82; 345/100; 345/204

(58) Field of Classification Search ..... 345/76, 345/98, 100, 204, 82
See application file for complete search history.

(56) References Cited

U.S. PATENT DOCUMENTS

| | | | | |
|---|---|---|---|---|
| 6,462,722 | B1 | 10/2002 | Kimura et al. | |
| 6,522,315 | B2 | 2/2003 | Ozawa et al. | |
| 6,839,045 | B2 | 1/2005 | Ozawa et al. | |
| 6,862,013 | B2 | 3/2005 | Takeuchi et al. | |
| 2002/0011982 | A1 * | 1/2002 | Takeuchi et al. | 345/92 |
| 2002/0196206 | A1 | 12/2002 | Kimura et al. | |
| 2003/0098827 | A1 | 5/2003 | Ozawa et al. | |
| 2003/0178948 | A1 | 9/2003 | Park et al. | |
| 2003/0231273 | A1 | 12/2003 | Kimura et al. | |
| 2004/0150591 | A1 | 8/2004 | Ozawa et al. | |
| 2004/0256996 | A1 | 12/2004 | Osame et al. | |
| 2005/0162354 | A1 | 7/2005 | Osame et al. | |
| 2005/0205880 | A1 | 9/2005 | Anzai et al. | |
| 2005/0285823 | A1 * | 12/2005 | Kimura et al. | 345/76 |
| 2006/0007218 | A1 | 1/2006 | Miyake et al. | |
| 2006/0076567 | A1 | 4/2006 | Miyagawa et al. | |
| 2006/0109215 | A1 | 5/2006 | Tanada et al. | |

FOREIGN PATENT DOCUMENTS

| | | |
|---|---|---|
| CN | 1336568 | 2/2002 |
| JP | 3620538 | 2/2005 |

OTHER PUBLICATIONS

European Search Report re application No. EP 07000060.9, dated Feb. 4, 2009.
Office Action re Chinese application No. CN 200710001711.0, dated Oct. 30, 2009 (with English translation).

* cited by examiner

*Primary Examiner*—Richard Hjerpe
*Assistant Examiner*—Saifeldin Elnafia
(74) *Attorney, Agent, or Firm*—Husch Blackwell Sanders LLP

(57) ABSTRACT

A display device is proposed in which scan line driver circuits are not disposed on opposite sides of a scan line, but one end of the scan line is driven by a scan line driver circuit, while the other end of the scan line is driven by a scan line auxiliary circuit which has a significantly smaller circuit scale and lower power consumption than the scan line driver circuit. The scan line auxiliary circuit is controlled with a selection pulse of the scan line or a signal of the scan line driver circuit, and is electrically connected to a fixed potential through a transistor. When a potential of the scan line is switched by the scan line driver circuit, the scan line auxiliary circuit operates so that the scan line is driven from its opposite ends.

10 Claims, 11 Drawing Sheets

PRIOR ART

DISPLAY DEVICE

BACKGROUND OF THE INVENTION

1. Field of the Invention

The present invention relates to a display device. In particular, the invention relates to a circuit configuration for driving scan lines or data lines of pixels in an active matrix display device which includes light-emitting elements.

2. Description of the Related Art

In recent years, further development of thin displays has been advanced in response to the growing demand for applications of thin displays to mainly television sets, computer monitors, mobile terminals, and the like. As a thin display, there are a liquid crystal display device (LCD) and a display device having light-emitting elements. In particular, an active matrix display using light-emitting elements is expected as the next-generation display because not only can it achieve a thin-shape, lightweight, and high-definition display, and the like which are the same features as those of the existing LCDs, but also it has advantages such as a high response speed, wide viewing angles, and the like.

As the most basic pixel configuration of an active matrix display using light-emitting elements, a configuration shown in FIG. 11A can be given as an example (for example, see Japanese Patent No. 3620538). The pixel shown in FIG. 11A includes a driving transistor 2402 for controlling a current supply to a light-emitting element 2404, a switching transistor 2401 for delivering a potential of a data line 2406 to a gate node G of the driving transistor 2402 when the pixel is selected by a scan line 2405, and a storage capacitor 2403 for holding a potential of the node G One electrode of the storage capacitor 2403 and one of a source electrode and a drain electrode of the driving transistor 2402 are connected to a current supply line 2407. The other of the source electrode and the drain electrode of the driving transistor 2402 is connected to a counter electrode 2408 through the light-emitting element 2404. FIG. 11B shows an example of the signal timing of the scan line 2405, the data line 2406, and the node G.

As a method for expressing gray scales, there are an analog driving method and a digital driving method. In the analog driving method, an analog voltage is supplied to a gate of a driving transistor so that the value of a current supplied to a light-emitting element is changed in an analog manner. On the other hand, in the digital driving method, one of two signal values for selecting light emission or non-light emission of a light-emitting element is supplied to a gate of a driving transistor, and the luminance level of the light-emitting element is fixed in the whole light-emitting time, so that gray scales are expressed by controlling the length of the light-emitting time of the light-emitting element.

SUMMARY OF THE INVENTION

Scan lines and data lines are often driven by a scan line driver circuit and a signal line driver circuit respectively, each of which is provided on one side of the periphery of a pixel portion. However, depending on the number of pixels, screen size, or driving method, the scan lines and the data lines may not be operated normally by the scan line driver circuit and the signal line driver circuit respectively, each of which is provided on one side of the pixel portion, due to the wiring resistance or parasitic capacitance of the scan lines or the data lines, or the like.

In view of such a circumstance, there is a configuration where scan line driver circuits are disposed on opposite sides of a pixel portion, and signal line driver circuits are disposed on the other opposite sides likewise, so that pixels are driven from opposite sides thereof. However, disposing the driver circuits on the opposite sides of the pixel portion will lead to an increase of layout area and power consumption.

It is the gist of the invention to provide a display device with a scan line driver circuit and a scan line auxiliary circuit which has a smaller circuit scale and lower power consumption than the scan line driver circuit. In the invention, a scan line auxiliary circuit means a circuit which includes at least a switching element and operates in such a way that by controlling the switching element using a selection pulse of a scan line or a signal of a scan line driver circuit, the scan line is connected to a power supply line having a fixed potential through the switching element. A transistor or the like is used as the switching element. When a potential of the scan line is changed by the scan line driver circuit, the scan line auxiliary circuit operates so that the scan line is connected to the power supply line. As a result, the scan line is driven from its opposite sides. The configuration of the scan line auxiliary circuit is not limited to one, and therefore, other configurations which can drive the scan line from its opposite sides can be employed, such as a configuration which utilizes a potential obtained by inverting the potential of the scan line.

One aspect of the invention is a display device which includes a scan line driver circuit, a scan line having one end connected to the scan line driver circuit, and a scan line auxiliary circuit which is connected to the other end of the scan line and has at least one switching element. When a signal potential of the scan line is changed by the scan line driver circuit, the scan line auxiliary circuit controls the switching element so that the scan line is connected to a power supply line having a fixed potential through the switching element.

Another aspect of the invention is a display device which includes a first scan line driver circuit, a second scan line driver circuit, a first scan line having one end connected to the first scan line driver circuit, a second scan line having one end connected to the second scan line driver circuit, and a scan line auxiliary circuit which is connected to the other end of the first scan line and has at least one switching element. When a signal potential of the first scan line is changed by the first scan line driver circuit, the scan line auxiliary circuit controls the switching element using a potential which is obtained by inverting the signal potential of the first scan line and a signal potential of the second scan line which is supplied from the second scan line driver circuit, so that the first scan line is connected to a power supply line having a fixed potential through the switching element.

By providing a scan line auxiliary circuit, scan lines can be driven substantially at the same level as in the case of driving the scan lines from their opposite sides. Accordingly, rather than by providing the same scan line driver circuits on opposite sides of a pixel portion, this structure can reduce the circuit scale, which results in a reduction in layout area and power consumption.

DETAILED DESCRIPTION OF THE INVENTION

Embodiment Mode

Figure 1A:
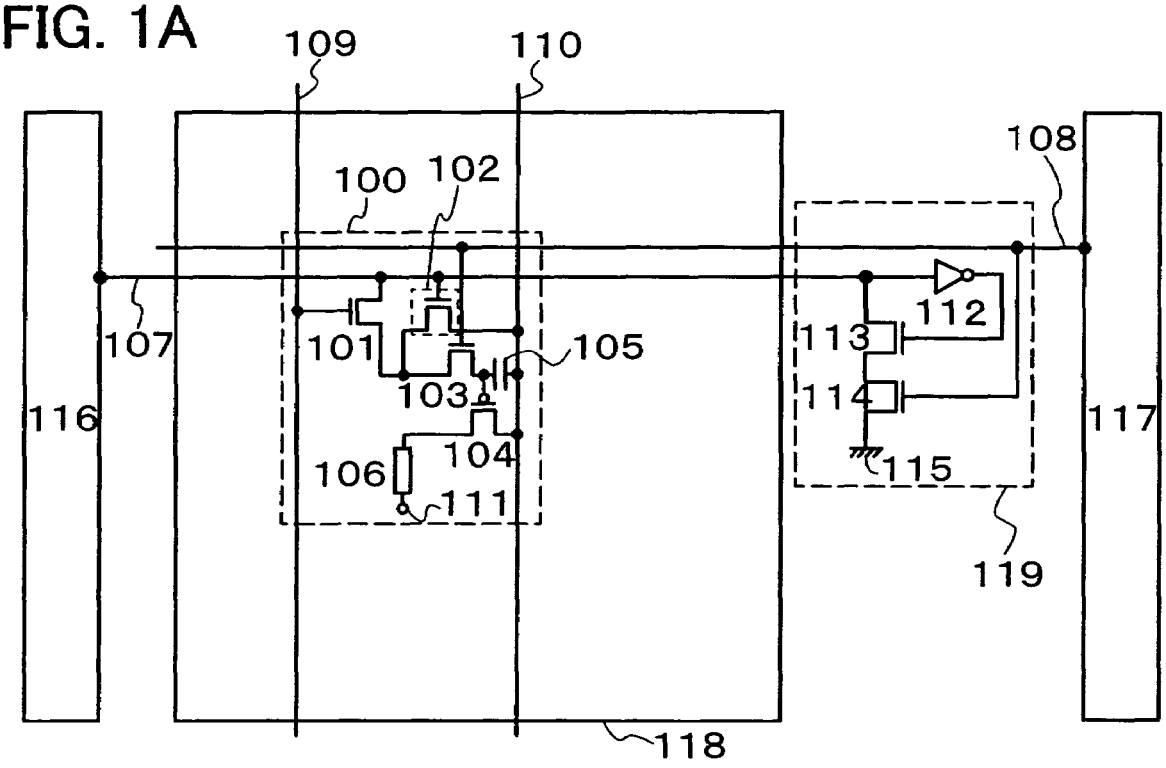
FIG. 1A is a circuit diagram of a display device in accordance with Embodiment Mode.
Figure 1B:
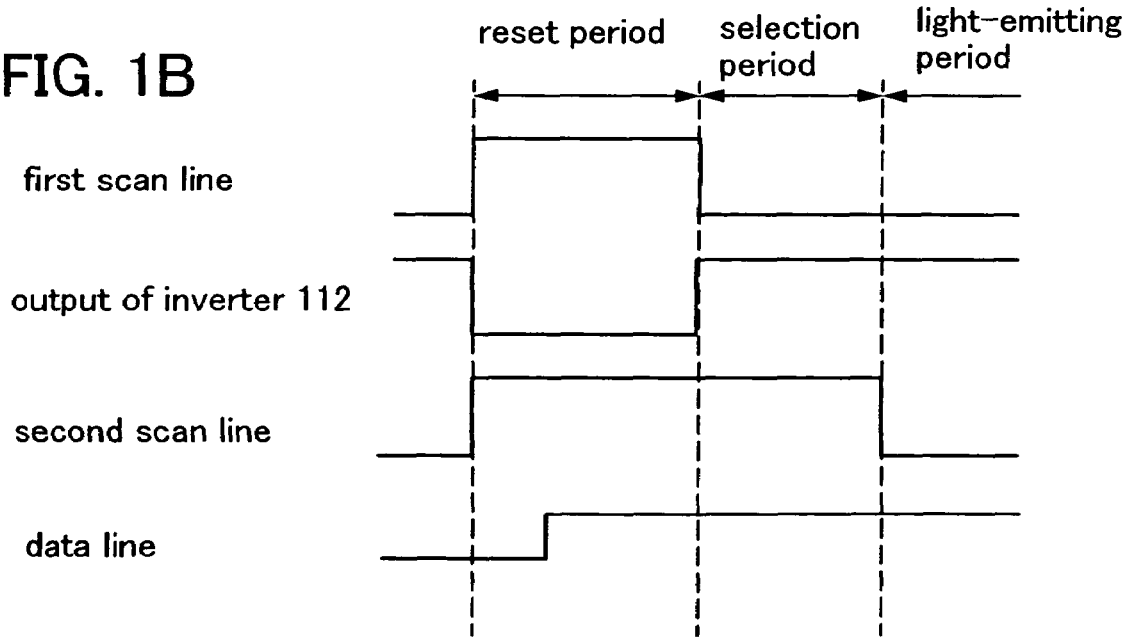
FIG. 1B is a timing chart thereof.

FIG. 1A shows an exemplary configuration having a scan line auxiliary circuit of the invention. Each pixel circuit in a pixel portion includes four transistors and one capacitor, and one frame includes a reset period, a selection period, and a light-emitting period as shown in FIG. 1B. In addition, the pixel circuit is connected to a first scan line 107, a second scan line 108, a data line 109, and a current supply line 110. Although only one pixel is shown here, the pixel portion of the display device actually has a plurality of pixels which are arranged in matrix of rows and columns.

A pixel 100 includes a selection transistor 101, a reset transistor 102, a switch transistor 103, a driving transistor 104, a storage capacitor 105, a light-emitting element 106, and a counter electrode 111. In addition, the pixel 100 is connected to the data line 109, the current supply line 110, the first scan line 107, and the second scan line 108. The first scan line 107 is connected to a first scan line driver circuit 116, while the second scan line 108 is connected to a second scan line driver circuit 117.

A scan line auxiliary circuit 119 is disposed on the opposite side of the first scan line driver circuit 116 which drives the first scan line 107, with a pixel portion 118 interposed therebetween.

One end of the first scan line 107 is connected to the first scan line driver circuit 116, while the other end thereof is connected to an input portion of an inverter 112 included in the scan line auxiliary circuit 119. A first n-channel transistor 113 and a second n-channel transistor 114 which function as switch elements are connected in series between the input portion of the inverter 112 and a GND 115. A gate of the first n-channel transistor1 113 is connected to an output portion of the inverter 112, and a gate of the second n-channel transistor 114 is connected to an output portion of the second scan line driver circuit 117 which receives an output from the second scan line 108.

FIG. 1A shows a display device including the first scan line 107, the second scan line 108, the data line 109, the current supply line 110, and the pixel 100 which has the light-emitting element 106 and an element for controlling the light-emitting state of the light-emitting element 106. The pixel portion 118 has an arrangement of a plurality of the pixels 100. One end of the first scan line 107 is connected to the first scan line driver circuit 116, while the other end thereof is connected to the scan line auxiliary circuit 119, so that a potential of the first scan line 107 is controlled by the two circuits. One end of the second scan line 108 is connected to the second scan line driver circuit 117, and supplies a signal potential to the scan line auxiliary circuit 119. The pixel portion 118 includes the driving transistor 104 which is connected in series between the current supply line 110 and the light-emitting element 106, the storage capacitor 105 which is connected between a gate electrode of the driving transistor 104 and the current supply line 110, the reset transistor 102 which has a gate electrode connected to the first scan line 107 and is connected so as to supply a potential of the current supply line 110 to the storage capacitor 105, the switch transistor 103 which has a gate electrode connected to the second scan line 108 and is connected between the reset transistor 102 and the storage capacitor 105, and the selection transistor 101 which has a gate electrode connected to the data line 109 and is connected in series between the switch transistor 103 and the first scan line 107. The scan line auxiliary circuit 119 is connected to the other end of the first scan line 107. When a signal potential of the first scan line 107 is changed by the first scan line driver circuit 116, the scan line auxiliary circuit 119 operates so that the first scan line 107 is connected to the GND 115 and the gate electrode of the driving transistor 104 is also connected to the GND 115 by using a potential which is obtained by inverting the signal potential of the first scan line 107 and also using a signal potential which is supplied from the second scan line driver circuit 117 to the second scan line 108. Note that in FIG. 1A, the GND 115 can be replaced with a power supply line having a desired fixed potential.

FIG. 1B is a timing chart. Examples of potentials are shown below in parentheses. In the reset period, the first scan line 107 and the second scan line 108 have a high potential (10 V) (hereinafter also referred to as an "H" level), and the reset transistor 102 and the switch transistor 103 are turned on. Thus, the gate electrode of the driving transistor 104 has a potential of the current supply line 110 (8 V), and thus the driving transistor 104 is turned off.

In the reset period, potentials of the data lines of all columns are determined in accordance with video signals. Given that the data lines of all columns receive signals indicative of a light-emitting state, the data lines have potentials of "H" level (3 V). When the operation proceeds to the selection period, the first scan line 107 has a low potential (0 V) (hereinafter also referred to as an "L" level), which means the "H" level (8 V) of the storage capacitors 105 in all of the pixels in X rows is lowered to the "L" level (0 V).

At this time, the output of the inverter 112 is at "H" level (10 V) and the first n-channel transistor 113 is on, and also the second scan line 108 is at "H" level (10 V) and the second n-channel transistor 114 is on. Therefore, the first scan line 107 can draw a current from both the first scan line driver circuit 116 and the scan line auxiliary circuit 119 to the GND 115. By driving the first scan line 107 from its opposite sides, the first scan line 107 can be set at a predetermined potential more surely than the case of driving it from a single side.

Provided that there are 720 (240×RGB) pixels in X direction, and the storage capacitance of one pixel is 100 fF, the total storage capacitance of one row in X direction is 72 pF. When the first scan line which holds such volume of storage capacitance is driven from a single side, a large load is imposed because of the wiring resistance of the first scan line 107, a buffer of the first scan line driver circuit 116, the resistance of the current supply line 110, and the like. Thus, it becomes difficult to set the first scan line 107 at a desired potential in a predetermined period of time. However, by providing the scan line auxiliary circuit 119 on the opposite side of the first scan line driver circuit 116 which drives the first scan line 107, with the pixel portion 118 interposed therebetween in order to drive the first scan line 107 from its opposite sides, the driving ability can be significantly improved. The scan line auxiliary circuit 119 may be controlled with selection pulses of the first scan line 107 and the second scan line 108; therefore, big advantageous effects can be obtained with a small-scale circuit.

Note that the configuration of the scan line auxiliary circuit 119 is not limited to the one shown in FIG. 1A. Gate connections of the first n-channel transistor 113 and the second n-channel transistor 114 may be interchanged or the scan line auxiliary circuit 119 can be changed to a circuit having a similar function.

In addition, the pixel circuit connected to the scan line auxiliary circuit 119 is not limited to the configuration shown in FIG. 1A, and a pixel circuit with a different configuration can be provided.

Note that in this specification, "connection" means "electrical connection unless otherwise mentioned.

Although embodiments of the invention will be described in detail below with reference to the accompanying drawings, it will be easily understood by those skilled in the art that various changes and modifications are possible within the spirit and scope of the invention. Thus, the invention is not limited to the description of the following embodiments.

Embodiment 1

Figure 2:
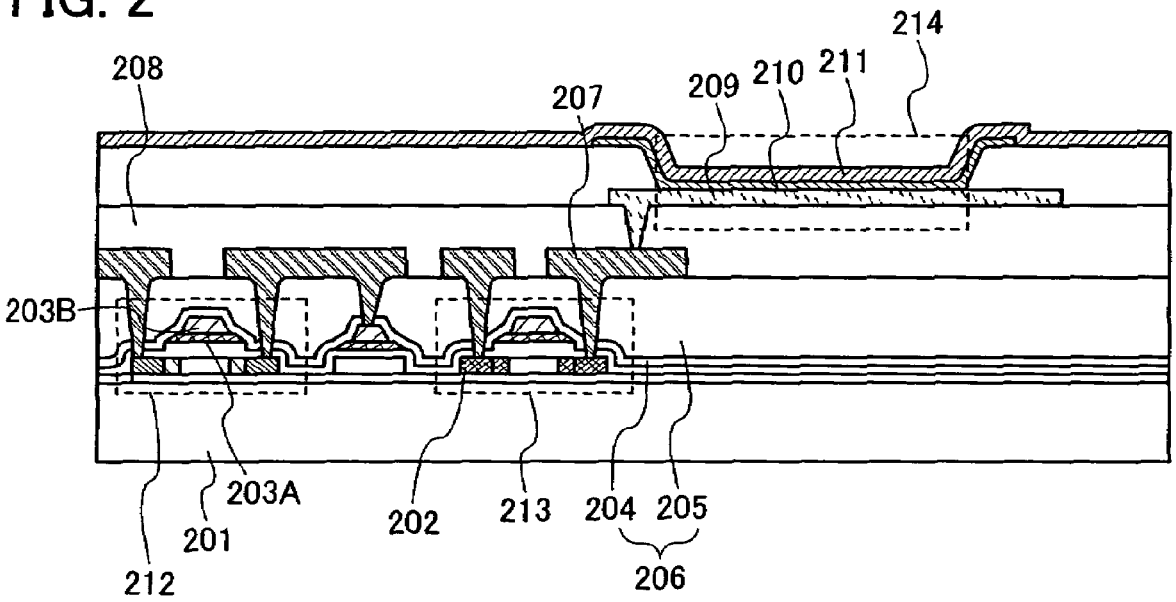
FIG. 2 is a cross-sectional view of a display device in accordance with Embodiment 1.

A cross-sectional structure of a display device of this embodiment is described with reference to FIG. 2. Here, description is made of a cross-sectional structure of the display device shown in FIG. 1A, which includes a selection transistor 212, a driving transistor 213, and a light-emitting element 214.

As a substrate 201 having an insulating surface, a glass substrate, a quartz substrate, a stainless steel substrate, or the like can be used. Alternatively, other substrates which are resistant to the treatment temperature in the manufacturing process can be used, for example, a flexible substrate made of synthetic resin such as plastic (e.g., polyethylene terephthalate (PET) or polyethylene naphthalate (PEN)) or acrylic.

First, a base film is formed over the substrate 201. As the base film, an insulating film made of silicon oxide, silicon nitride, silicon nitride oxide, or the like can be used. Next, an amorphous semiconductor film is formed over the base film. The amorphous semiconductor film is formed to have a thickness of 25 to 100 nm. As the amorphous semiconductor, not only silicon but also silicon germanium can be used. Then, the amorphous semiconductor film is crystallized as appropriate to form a crystalline semiconductor film 202. As the crystallization method, thermal treatment with a heating furnace, laser irradiation, irradiation with light emitted from a lamp, or a combination of such treatment can be used. For example, a crystalline semiconductor film is formed by doping an amorphous semiconductor film with a metal element, and then applying thermal treatment with a heating furnace thereto. By doping an amorphous semiconductor film with a metal element in this manner, crystallization can be conducted at a low temperature, which is preferable.

Note that a thin film transistor (TFT) formed of a crystalline semiconductor has higher electron field-effect mobility and larger on-current than a TFT formed of an amorphous semiconductor. Therefore, it is more suitable as a transistor used for a display device.

Next, the crystalline semiconductor film 202 is patterned into predetermined shapes. Next, an insulating film functioning as a gate insulating film is formed. The insulating film is formed to have a thickness of 10 to 150 nm so as to cover the semiconductor film. For example, a single-layer structure or a stacked-layer structure of a silicon oxynitride film, silicon oxide film, or the like can be used.

Next, a conductive film functioning as a gate electrode is formed over the gate insulating film. Although the gate electrode may have either a single layer or stacked layers, it is formed here by stacking conductive films (203A and 203B). The conductive films 203A and 203B are formed with an element selected from Ta, W, Ti, Mo, Al, or Cu, or an alloy material or a compound material containing such the element as a main component. For example, a tantalum nitride film with a thickness of 10 to 50 nm is formed as the conductive film 203A, and a tungsten film with a thickness of 200 to 400 nm is formed as the conductive film 203B.

Next, an impurity region is formed by doping the semiconductor film 202 with an impurity element by using the gate electrode as a mask. At this time, a low concentration impurity region may be formed in addition to a high concentration impurity region. The low concentration impurity region is also called an LDD (Lightly Doped Drain) region.

Next, a first insulating film 204 and a second insulating film 205 which function as an interlayer insulating film 206 are formed. The first insulating film 204 is preferably an insulating film containing nitrogen. Here, it is formed by depositing a silicon nitride film with a thickness of 50 to 100 nm by a plasma CVD method. The second insulating film 205 is preferably formed using an organic material or an inorganic material. As the organic material, polyimide, acrylic, polyamide, polyimide amide, benzocyclobutene, or siloxane can be used. Siloxane has a skeletal structure with the bond of silicon (Si) and oxygen (O). As a substituent of siloxane, an organic group containing at least hydrogen (e.g., an alkyl group or aromatic hydrocarbon) is used. Alternatively, a fluoro group may be used as the substituent, or both a fluoro group and an organic group containing at least hydrogen may be used as the substituent. As the inorganic material, an insulating film containing oxygen or nitrogen can be used, such as silicon oxide ($SiO_x$), silicon nitride ($SiN_x$), silicon oxynitride ($SiO_xN_y$), ($x>y$), or silicon nitride oxide ($SiN_xO_y$) ($x>y$) (x and y are natural numbers). While a film made of an organic material has high planarity, it absorbs moisture or oxygen due to the constituent organic material. In order to prevent this, an insulating film containing an inorganic material is preferably formed over the insulating film made of the organic material.

Next, contact holes are formed in the interlayer insulating film 206, followed by formation of conductive films 207 which function as source wirings and drain wirings of the transistors. The conductive films 207 can be formed using a film made of an element such as aluminum (Al), titanium (Ti), molybdenum (Mo), tungsten (W), or silicon (Si), or an alloy film containing such an element. For example, a titanium film, a titanium nitride film, an alloy film of titanium and aluminum, or a stacked film of a titanium film is formed.

Next, a third insulating film 208 is formed to cover the conductive films 207. The third insulating film 208 can be formed with any material described for the interlayer insulating film 206. Next, a pixel electrode 209 (also called a first electrode) is formed in an opening provided in the third insulating film 208. In order to increase the step coverage of the pixel electrode 209 at the opening, the opening is preferably formed to be roundish such that the edge of the opening has a plurality of curvature radii.

The pixel electrode 209 is preferably formed with a conductive material with a high work function (4.0 eV or higher) such as a metal, an alloy, an electrically conductive compound, or a mixture of them. As specific examples of a conductive material, indium oxide containing tungsten oxide (IWO), indium zinc oxide containing tungsten oxide (IWZO), indium oxide containing titanium oxide (ITiO), indium tin oxide containing titanium oxide (ITTiO), and the like can be given. Needless to say, indium tin oxide (ITO), indium zinc oxide (IZO), indium tin oxide to which silicon oxide is added (ITSO), or the like can also be used.

Exemplary composition ratios of the conductive material are as follows. Indium oxide containing tungsten oxide may have a composition ratio of tungsten oxide: 1 wt % and indium oxide: 99 wt %. Indium zinc oxide containing tungsten oxide may have a composition ratio of tungsten oxide: 1 wt %, zinc oxide: 0.5 wt %, and indium oxide: 98.5 wt %. Indium oxide containing titanium oxide may have a composition ratio of titanium oxide: 1 to 5 wt %, and indium oxide: 99 to 95 wt %. Indium tin oxide (ITO) may have a composition ratio of tin oxide: 10 wt % and indium oxide: 90 wt %. Indium zinc oxide (IZO) may have a composition ratio of zinc oxide: 11 wt % and indium oxide: 89 wt %. Indium tin oxide containing titanium oxide may have a composition ratio of titanium oxide: 5 wt %, tin oxide: 10 wt %, and indium oxide: 85 wt %. The above composition ratios are only exemplary, and therefore, the composition ratio may be set appropriately.

Next, a light-emitting layer 210 is formed by a vapor-deposition method or an inkjet-deposition method. The light-emitting layer 210 includes an organic material or an inorganic material and is formed by combining an electron injection layer (EIL), an electron transport layer (ETL), a light-emitting layer (EML), a hole transport layer (HTL), a hole injection layer (HIL), and the like as appropriate. Note that the boundary between layers is not necessarily required to be clear, and therefore, materials which form the layers may be partially mixed with each other, in which case the interface between the layers is unclear.

Note that the light-emitting layer is preferably formed with a plurality of layers having different functions such as a hole injection/transport layer, a light-emitting layer, and an electron injection/transport layer.

Note also that the hole injection/transport layer is preferably formed of a composite material containing an organic compound material with a hole transport property and an inorganic compound material which exhibits an electron accepting property with respect to the organic compound material. By employing such a structure, many hole carriers are generated in the organic compound which has few inherent carriers. As a result, an excellent hole injection property and hole transport property can be obtained. By such an effect, driving voltage can be reduced than the conventional. Further, since the hole injection/transport layer can be made thick without causing an increase of the driving voltage, short circuit of the light-emitting element due to dust or the like can be suppressed.

As an organic compound material with a hole transport property, there are, for example, copper phthalocyanine (abbreviation: CuPc); vanadyl phthalocyanine (abbreviation: VOPc); 4,4',4"-tris(NN-diphenylamino)triphenylamine (abbreviation: TDATA); 4,4',4"-tris[N-(3-methylphenyl)-N-phenylamino]triphenylamine (abbreviation: MTDATA); 1,3,5-tris[N,N-di(m-tolyl)amino]benzene (abbreviation: m-MTDAB); N,N'-diphenyl-N,N'-bis(3-methylphenyl)-1,1'-biphenyl-4,4'-diamine (abbreviation: TPD); 4,4'-bis[N-(1-naphthyl)-N-phenylamino]biphenyl (abbreviation: NPB); 4,4'-bis{N-[4-(N,N-di-m-tolylamino)phenyl]-N-phenylamino}biphenyl (abbreviation: DNTPD); 4,4',4"-tris(N-carbazolyl)triphenylamine (abbreviation: TCTA); and the like. However, the invention is not limited to these.

As examples of an inorganic compound material which exhibits an electron accepting property, there are titanium oxide, zirconium oxide, vanadium oxide, molybdenum oxide, tungsten oxide, rhenium oxide, ruthenium oxide, zinc oxide, and the like. In particular, vanadium oxide, molybdenum oxide, tungsten oxide, and rhenium oxide are preferable since they can be deposited in vacuum, and are easy to be handled.

The electron injection/transport layer is formed with an organic compound material with an electron transport property. Specifically, the following materials can be used: tris(8-quinolinolato)aluminum ($Alq_3$); tris(4-methyl-8-quinolinolato)aluminum (abbreviation: $Almq_3$); bis(10-hydroxybenzo[h]quinolinato)beryllium (abbreviation: $BeBq_2$); bis(2-methyl-8-quinolinolato)(4-phenylphenolato)aluminum (abbreviation: BAlq); bis[2-(2'-hydroxyphenyl)benzoxazolato]zinc (abbreviation: $Zn(BOX)_2$); bis[2-(2'-hydroxypheyl)benzothiazolato]zinc (abbreviation: $Zn(BTZ)_2$); bathophenanthroline (abbreviation: BPhen); bathocuproin (abbreviation: BCP); 2-(4-biphenylyl)-5-(4-tert-butylphenyl)-1,3,4-oxadiazole (abbreviation: PBD); 1,3-bis[5-(4-tert-butylphenyl)-1,3,4-oxadiazol-2-yl]benzene (abbreviation: OXD-7); 2,2',2"-(1,3,5-benzenetriyl)-tris(1-phenyl-1H-benzimidazole) (abbreviation: TPBI); 3-(4-biphenylyl)-4-phenyl-5-(4-tert-butylphenyl)-1,2,4-triazole (abbreviation: TAZ); 3-(4-biphenylyl)-4-(4-ethylphenyl)-5-(4-tert-butylphenyl)-1,2,4-triazole (abbreviation: p-EtTAZ); and the like. However, the invention is not limited to these.

For the light-emitting layer, the following materials can be used: 9,10-di(2-naphthyl) anthracene (abbreviation: DNA); 9,10-di(2-naphthyl)-2-tert-butylanthracene (abbreviation: t-BuDNA); 4,4'-bis(2,2-diphenylvinyl)biphenyl (abbreviation: DPVBi); coumarin 30; coumarin 6; coumarin 545; coumarin 545T; perylene; rubrene; periflanthene; 2,5,8,11-tetra(tert-butyl)perylene (abbreviation: TBP); 9,10-diphenylanthracene (abbreviation: DPA); 5,12-diphenyltetracene; 4-(dicyanomethylene)-2-methyl-6-(p-dimethylaminostyryl)-4H-pyran (abbreviation: DCM1); 4-(dicyanomethylene)-2-methyl-6-[2-(joulolidine-9-yl)ethenyl]-4H-pyran (abbreviation: DCM2); 4-(dicyanomethylene)-2,6-bis[p-(dimethylamino)styryl]-4H-pyran (abbreviation: BisDCM); and the like. Alternatively, a compound capable of emitting phosphorescence can be used, such as bis[2-(4',6'-difluorophenyl)pyridinato-N,$C^{2'}$]iridium(picolinate) (abbreviation: Flrpic); bis{2-[3',5'-bis(trifluoromethyl)phenyl]pyridinato-N,$C^{2'}$}iridium(picolinate) (abbreviation: $Ir(CF_3ppy)_2(pic)$); tris(2-phenylpyridinato-N,$C^{2'}$)iridium (abbreviation: $Ir(ppy)_3$); bis(2-phenylpyridinato-N,$C^{2'}$)iridium(acetylacetonate) (abbreviation: $Ir(ppy)_2(acac)$); bis[2-(2'-thienyl)pyridinato-N,$C^{3'}$]iridium(acetylacetonate) (abbreviation: $Ir(thp)_2(acac)$); bis(2-phenylquinolinato-N,$C^{2'}$)iridium(acetylacetonate) (abbreviation: $Ir(pq)_2(acac)$); and bis[2-(2'-benzothienyl)pyridinato-N,$C^{3'}$] iridium(acetylacetonate) (abbreviation: $Ir(btp)_2(acac)$).

Further, in addition to the singlet excitation light-emitting material, the light-emitting layer may be formed by using a triplet excitation light-emitting material containing a metal complex. For example, among light-emitting pixels for red emission, green emission, and blue emission, the light-emitting pixel for red emission which has a relatively short luminance half decay time is formed by using a triplet excitation light-emitting material, while the other light-emitting pixels are formed by using a singlet excitation light-emitting material. The triplet excitation light-emitting material has high luminous efficiency, which is advantageous in that lower power consumption is required in order to obtain the same luminance. That is, when the triplet excitation light-emitting material is applied to the pixel for red emission, the amount of current supplied to the light-emitting element can be suppressed, which results in improvement in reliability. Alternatively, in order to suppress power consumption, the light-emitting pixels for red emission and green emission may be formed by using a triplet excitation light-emitting material, while the light-emitting element for blue emission may be formed by using a singlet excitation light-emitting material. When the light-emitting element for green emission which is highly visible to human eyes is formed by using the triplet excitation light-emitting material, further lower power consumption can be achieved.

As the structure of the light-emitting layer, light-emitting layers having different emission wavebands may be formed in the respective pixels to perform color display. Typically, light-emitting layers corresponding to the respective colors of R (Red), G (Green), and B (Blue) are formed. In this case also, by adopting a structure where filters which transmit light with the respective emission wavebands are provided on the emission side of the pixels, color purity can be improved and a mirror-like surface (glare) of the pixel portion can be prevented. By providing the filters, a circularly polarizing plate and the like which have conventionally been required can be omitted. As a result, loss of light emitted from the light-emitting layers can be eliminated. Further, changes in color tone, which are recognized when the pixel portion (display screen) is seen obliquely, can be reduced.

As a further alternative, the light-emitting layer can be formed by using an electroluminescent material of high molecular compounds such as a material containing polyparaphenylene vinylene, polyparaphenylene, polythiophene or polyfluorene.

It is also possible to use an inorganic material for the light-emitting layer. As the inorganic material, a material in which a compound semiconductor such as zinc sulfide (ZnS) is doped with an impurity such as manganese (Mn) or a rare-earth element (Eu, Ce, or the like) can be used. Such an impurity is called an emission center ion. Light emission can be obtained by electron transition between the ions. Alternatively, a material in which a compound semiconductor such as zinc sulfide (ZnS) is doped with Cu, Ag, Au, or the like as an acceptor element, and also doped with F, Cl, Br, or the like as a donor element can be used. In that case, light emission can be obtained by the transition between the acceptor element and the donor element. Further, GaAs may be added into such materials in order to increase the luminous efficiency. The light-emitting element may be formed to have a thickness of 100 to 1000 nm (preferably, 300 to 600 nm). A dielectric layer is provided between such a light-emitting layer and an electrode (an anode or a cathode) in order to increase the luminous efficiency. As the dielectric layer, barium titanate ($BaTiO_3$) or the like can be used. The dielectric layer is formed to have a thickness of 50 to 500 nm (preferably, 100 to 200 nm).

In any case, the layer structure of the light-emitting layer may be changed, and modification of the layer structure is possible within the range that the object of the light-emitting element can be attained, such that a specific hole or electron injection/transport layer or a light-emitting layer is omitted but instead, an alternative electrode layer functioning as such a layer is provided, or a light-emitting material is dispersed in the layer.

In addition, color filters (colored layers) may be formed over a sealing substrate. The color filters (colored layers) can be formed by a vapor-deposition method or a droplet discharge method. By using the color filters (colored layers), high-resolution display can be performed. This is because the provision of the color filters (colored layers) can correct the broad peak of each emission spectrum of RGB to be sharp.

In addition, by forming a light-emitting material with a single color and combining it with color filters or a color conversion layer, full color display can be performed. The color filters (colored layers) or the color conversion layer may be formed over, for example, a second substrate (sealing substrate), and then attached to the base substrate.

Next, a counter electrode (also called a second electrode) 211 is formed by a puttering method or a vapor-deposition method. One of the pixel electrode 209 and the counter electrode 211 functions as an anode and the other functions as a cathode.

As a cathode material, a material having a low work function (3.8 eV or lower) is preferably used such as a metal, an alloy, an electrically conductive compound, or a mixture of them. As specific examples of the cathode material, there are metals belonging to the group 1 or 2 of the periodic table, namely alkaline metals such as Li or Cs, alkaline earth metals such as Mg, Ca or Sr, alloys containing such metals (MgAg or AlLi), compounds containing such metals (LiF, CsF or $CaF_2$), or transition metals containing rare-earth metals. Note that since the cathode is required to transmit light, the cathode is formed by depositing the above-described metal or an alloy containing such a metal to be quite thin, and then stacking a metal (including an alloy) such as ITO thereon.

Then, a protective film made of a silicon nitride film or a DLC (Diamond Like Carbon) film may be provided so as to cover the counter electrode 211. Through the above-described steps, a display device of the invention is completed.

Embodiment 2

Figure 3:
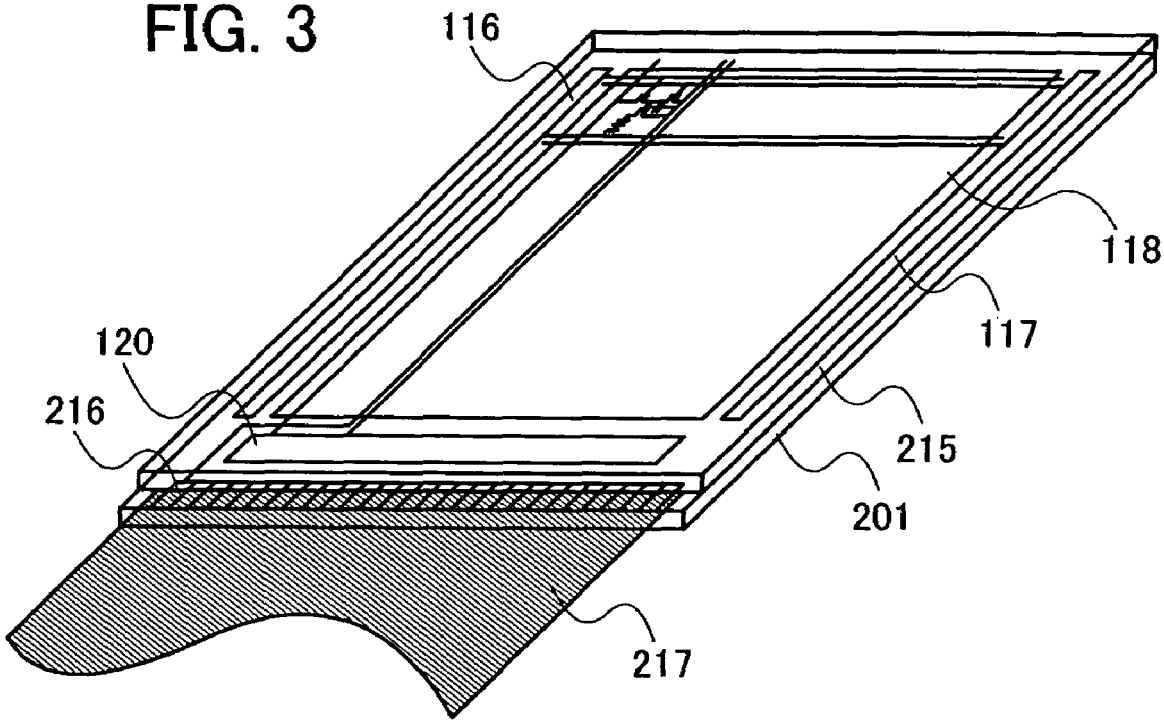
FIG. 3 is a perspective view of a display device in accordance with Embodiment 2.

In this embodiment, an example of an active matrix display using the pixel configuration of the invention is described with reference to FIG. 3.

An active matrix display includes a substrate 201 over which transistors and wirings are formed, a flexible wiring board 217 for electrically connecting a wiring portion to an external circuit, light-emitting elements, and a counter substrate 215 for sealing the light-emitting element.

The substrate 201 includes the pixel portion 118 in which a plurality of pixels are arranged in matrix, the signal line driver circuit 120, the first scan line driver circuit 116, the second scan line driver circuit 117, the scan line auxiliary circuit (not shown), and a flexible wiring board connection portion 216 which is connected to the flexible wiring board 217 for inputting various power supply voltages and signals.

The signal line driver circuit 120 includes circuits such as a shift register, a latch, a level shifter, and a buffer, and outputs data to a data line of each column. In addition, each of the first scan line driver circuit 116 and the second scan line driver circuit 117 includes circuits such as a shift register, a level shifter, and a buffer.

The light-emitting state of each light-emitting element is controlled in accordance with a data signal which is written into each pixel at the output timing of a selection pulse from the scan line driver circuits.

Note that circuits such as a microprocessor and a controller may also be formed over the substrate 201 in addition to the above-described driver circuits. In that case, the number of external circuits (IC) to be connected can be reduced, and reduction in weight and thickness can be achieved, which is particularly effective in the case of applying the display to portable terminals.

Note that in this specification, a panel where a flexible wiring board is attached and EL elements are used as light-emitting elements is called a display module.

This embodiment can be freely combined with Embodiment 1.

Embodiment 3

This embodiment describes a structure which can suppress fluctuations in the current value of a light-emitting element due to changes in ambient temperature or deterioration over time, by controlling a potential of a current supply line.

A light-emitting element has a characteristic that the resistance value (internal resistance value) thereof changes in accordance with changes in ambient temperature. Specifically, when the room temperature is assumed to be a normal temperature, the resistance value of a light-emitting element decreases when the ambient temperature becomes higher than the normal temperature, while increases when the ambient temperature becomes lower than the normal temperature. Therefore, when the ambient temperature becomes higher, a current flowing to the light-emitting element increases and the resulting luminance becomes higher than the predetermined level. On the other hand, when the ambient temperature becomes lower, a current flowing to the light-emitting element decreases when the same voltage is applied thereto, and thus the resulting luminance becomes lower than the predetermined level. In addition, the light-emitting element has another characteristic that the current value flowing thereto decreases over time. Specifically, with the accumulation of the light-emitting period and non-light-emitting period, the resistance value of the light-emitting element increases due to deterioration. Therefore, when the light-emitting period and non-light-emitting period have accumulated and the same voltage is applied to the light-emitting element, a current value flowing thereto decreases, and the resulting luminance becomes lower than the predetermined level.

Due to the above-described characteristics of the light-emitting element, variations in luminance occur when the ambient temperature changes or deterioration over time occurs. In a display device of this embodiment, fluctuations in the current value of a light-emitting element which result from changes in ambient temperature and deterioration over time can be suppressed by controlling a potential of a current supply line.

Figure 4:
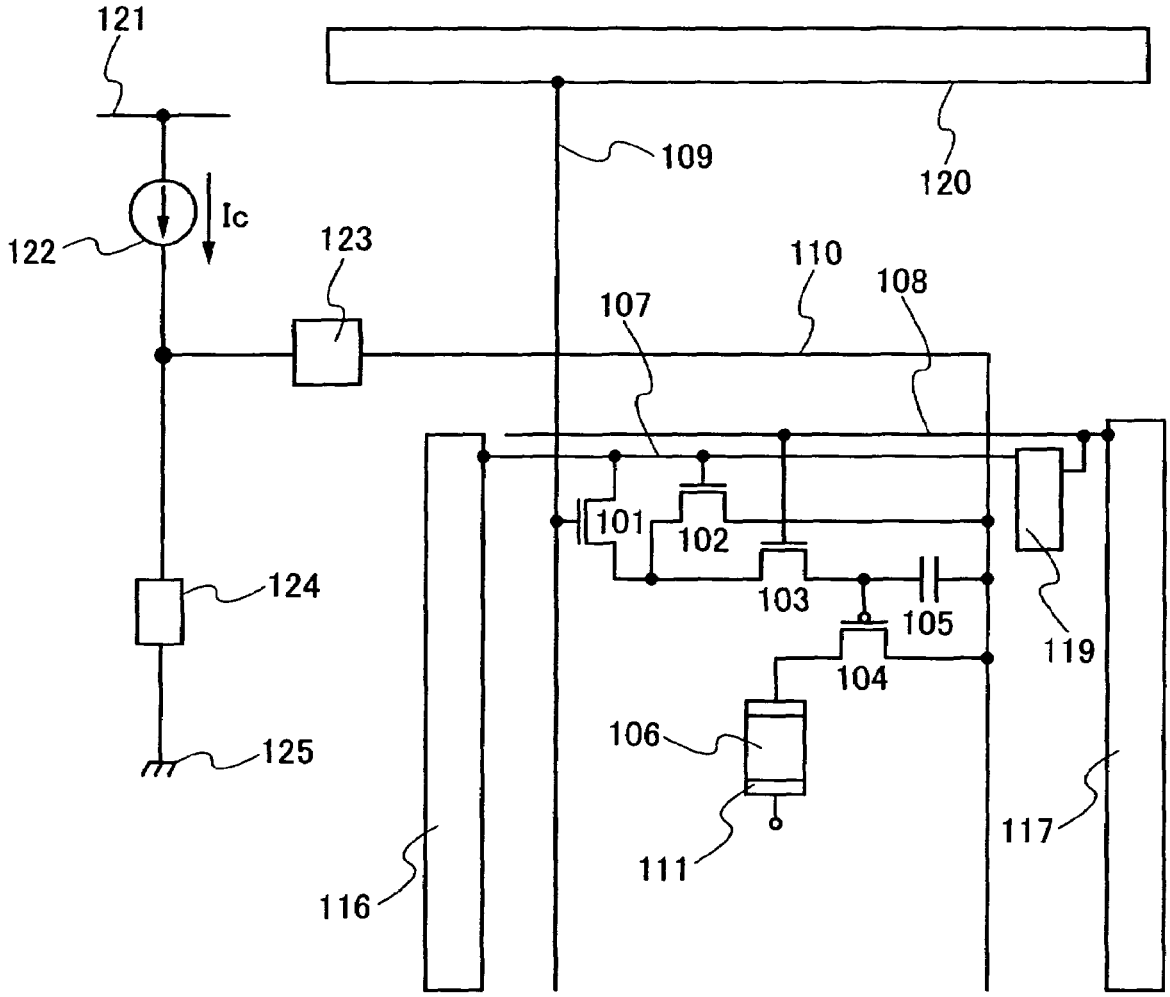
FIG. 4 is a circuit diagram of a display device in accordance with Embodiment 3.

FIG. 4 shows a circuit configuration of such a display device. A pixel has the pixel circuit shown in FIG. 1A, and therefore, description of the same components as those in FIG. 1A are omitted. Elements common to FIG. 1A and FIG. 4 are denoted by common reference numerals, and thus their description will be omitted.

This display device includes a monitoring circuit in addition to the first scan line driver circuit 116, the second scan line driver circuit 117, and the signal line driver circuit 120 for supplying video signals. Each pixel includes the reset transistor 102 having a gate connected to the first scan line 107, and the switch transistor 103 having a gate connected to the second scan line 108. In such a pixel configuration, when the potentials of the current supply line 110 and the counter electrode 111 are fixed, the characteristics of the light-emitting element 106 deteriorate if a current keeps flowing to the light-emitting element 106. Further, the characteristics of the light-emitting element 106 change in accordance with changes in ambient temperature.

Specifically, when a current keeps flowing to the light-emitting element 106, the voltage-current characteristics thereof shift. That is, the resistance value of the light-emitting element 106 becomes higher, and the value of a current flowing thereto becomes small even when the same voltage is applied. Meanwhile, even if the same amount of current flows to the light-emitting element 106, the luminous efficiency decreases, and thus the luminance becomes lower. As for the temperature characteristics, when the ambient temperature decreases, the voltage-current characteristics of the light-emitting element 106 shift, and the resistance value thereof becomes higher.

In view of the above circumstances, effects of the deterioration and fluctuations are suppressed by using a monitoring circuit. In this embodiment, fluctuations in the current value of the light-emitting element 106 which result from deterioration over time or changes in ambient temperature are suppressed by controlling a potential of the current supply line 110.

A monitoring current source 122 and a monitoring light-emitting element 124 are connected between a first monitoring power supply line 121 and a second monitoring power supply line 125. A connection node of the monitoring current source 122 and the monitoring light-emitting element 124 is connected to an input terminal of a sampling circuit 123 for outputting a voltage of the monitoring light-emitting element 124. An output terminal of the sampling circuit 123 is connected to the power supply line 110. Therefore, a potential of the current supply line 110 is controlled by an output of the sampling circuit 123.

Next, the operation of the monitoring circuit is described. The monitoring current source 122 supplies the amount of a current which is necessary for the light-emitting element 106 to emit light at the maximum luminance (highest number of gray scales). The current value at this time is denoted by Imax.

Then, a voltage which is necessary to flow Imax is applied to opposite terminals of the monitoring light-emitting element 124. Thus, even when the voltage-current characteristics of the monitoring light-emitting element 124 change due to deterioration over time or changes in ambient temperature, voltages of the opposite terminals of the monitoring light-emitting element 124 change correspondingly, and thus have optimal values. Accordingly, effects of fluctuations of the monitoring light-emitting element 124 (e.g., deterioration or temperature change) can be suppressed.

The input terminal of the sampling circuit 123 receives a voltage which is applied to the monitoring light-emitting element 124. Therefore, a potential of the output terminal of the sampling circuit 123, that is, a potential of the current supply line 110 is corrected by the monitoring circuit. As a result, fluctuations in the current value of the light-emitting element 106 which result from deterioration over time or changes in ambient temperature are suppressed.

It is acceptable as long as the sampling circuit 123 is a circuit which outputs a voltage in accordance with an input current. For example, a voltage follower circuit or an amplifier circuit may be used. Alternatively, an operational amplifier may also be used. Such circuits may be constructed from bipolar transistors or MOS transistors, or by combining them.

Note that the monitoring light-emitting element 124 is desirably formed over the same substrate and by the same manufacturing method as the light-emitting element 106 in the pixel. By forming the monitoring light-emitting element and the light-emitting element disposed in the pixel through the same manufacturing process, uniform electrical characteristics can be obtained.

Since there are frequent periods when current is not supplied to the light-emitting element 106 in the pixel, deterioration of the light-emitting element 106 does not advance. In comparison with the light-emitting element 106, the monitoring light-emitting element 124 deteriorates at faster speed if a current is continuously supplied to the monitoring light-emitting element 124, which results in higher resistance. Therefore, a high degree of correction is applied to the sampling circuit 123, which in turn outputs a high voltage. As a result, a potential of the current supply line 110 becomes high and the light-emitting element 106 emits light at a luminance higher than the necessary level. Thus, correction may be applied in accordance with the actual deterioration level of the light-emitting element in the pixel. For example, if the average emission rate of the whole pixels is 30%, a current may be supplied to the monitoring light-emitting element 124 only in the period corresponding to 30% of the luminance. At this time, there arises a period when no current is supplied to the monitoring light-emitting element 124; however, voltage is required to be constantly supplied from the output terminal of the sampling circuit 123. In order to realize such voltage supply, a storage capacitor may be connected to the input terminal of the sampling circuit 123 so as to hold a potential at the time when a current has been supplied to the monitoring light-emitting element 124.

Note that when the monitoring circuit is operated in accordance with the highest gray-scale level, a high degree of correction is applied to the sampling circuit 123, which in turn outputs a high voltage. However, it can make screen burn-in which occurs in the pixels (luminance unevenness resulting from variations of deterioration levels among pixels) less noticeable. Therefore, the monitoring circuit is desirably operated in accordance with the highest gray-scale level.

In this embodiment, it is further preferable to operate the driving transistor 104 in the linear region. By operating the driving transistor 104 in the linear region, it can roughly operate as a switch. Therefore, effects of the characteristic change of the driving transistor 104 due to deterioration over time or changes in ambient temperature can be suppressed. In the case of operating the driving transistor 104 only in the linear region, a current supply to the light-emitting element 106 is often controlled digitally. In that case, it is preferable to combine a time gray scale method, an area gray scale method, and the like in order to achieve multi-gray scale display.

In addition, since on/off potentials applied to the gate electrode of the driving transistor in the pixel portion can be set separately from the potential of the data line, the maximum potential amplitude of the data line can be set small. Accordingly, a display device whose power consumption is significantly suppressed can be provided, and also an electronic device whose power consumption is significantly suppressed can be provided.

This embodiment can be freely combined with Embodiments 1 and 2.

Embodiment 4

This embodiment describes exemplary electronic devices in accordance with the invention, with reference to FIGS. 5, 6, 7A, 7B, 8A, 8B, 9, and 10A to 10E.

Figure 5:
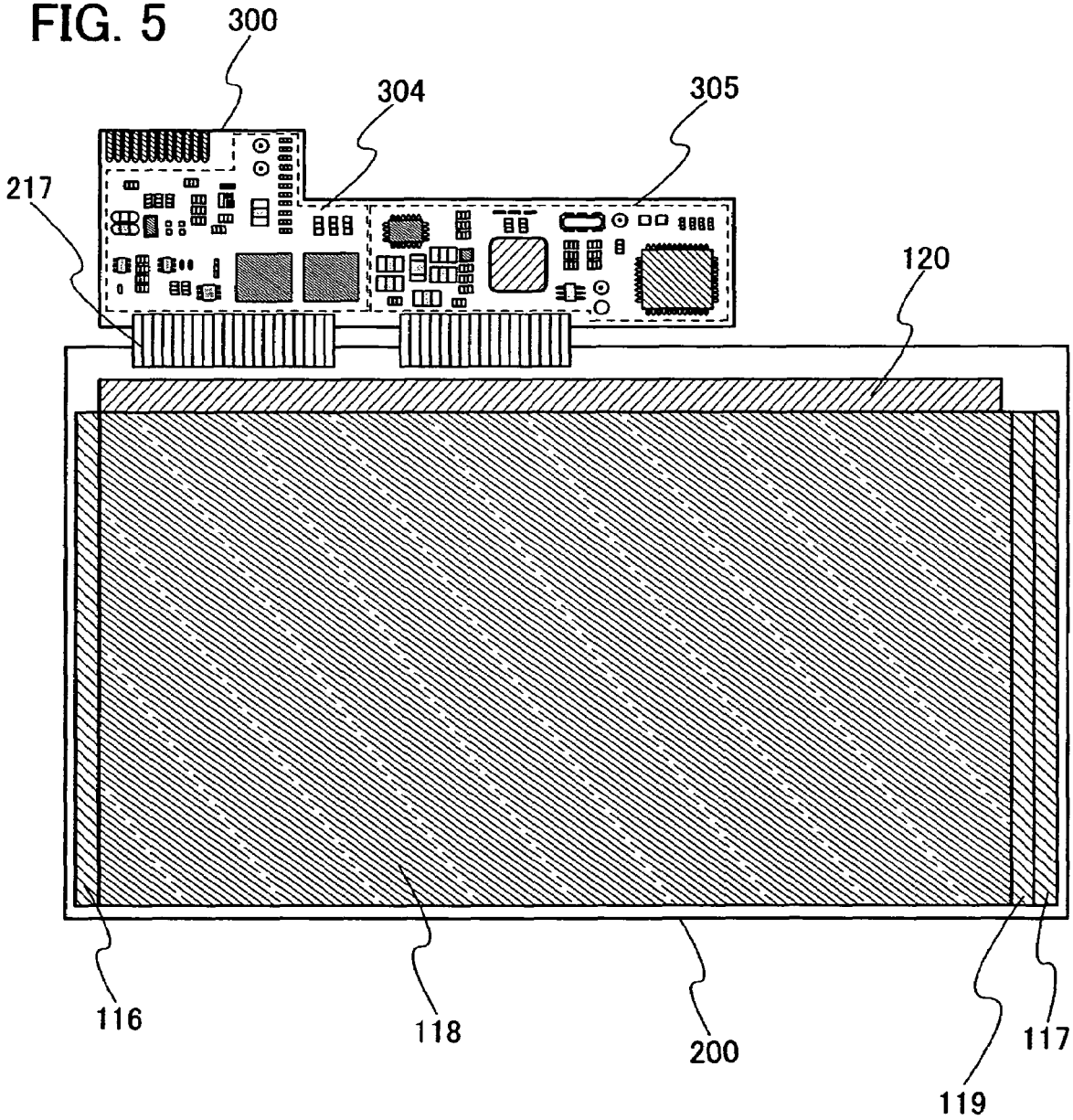
FIG. 5 is a view of an electronic device in accordance with Embodiment 4.

FIG. 5 shows a display module which combines a display panel 200 and a circuit board 300. A control circuit 304, a signal dividing circuit 305, and the like are formed over the circuit board 300, and the circuit board 300 is electrically connected to the display panel 200 through a flexible wiring board 217.

This display panel 200 includes the pixel portion 118 where a plurality of pixels are arranged, the first scan line driver circuit 116, the second scan line driver circuit 117, the scan line auxiliary circuit 119, and the signal line driver circuit 120 for supplying video signals to the pixels. The display panel 200 can have a similar configuration to those in Embodiments 1 to 3.

Figure 6:
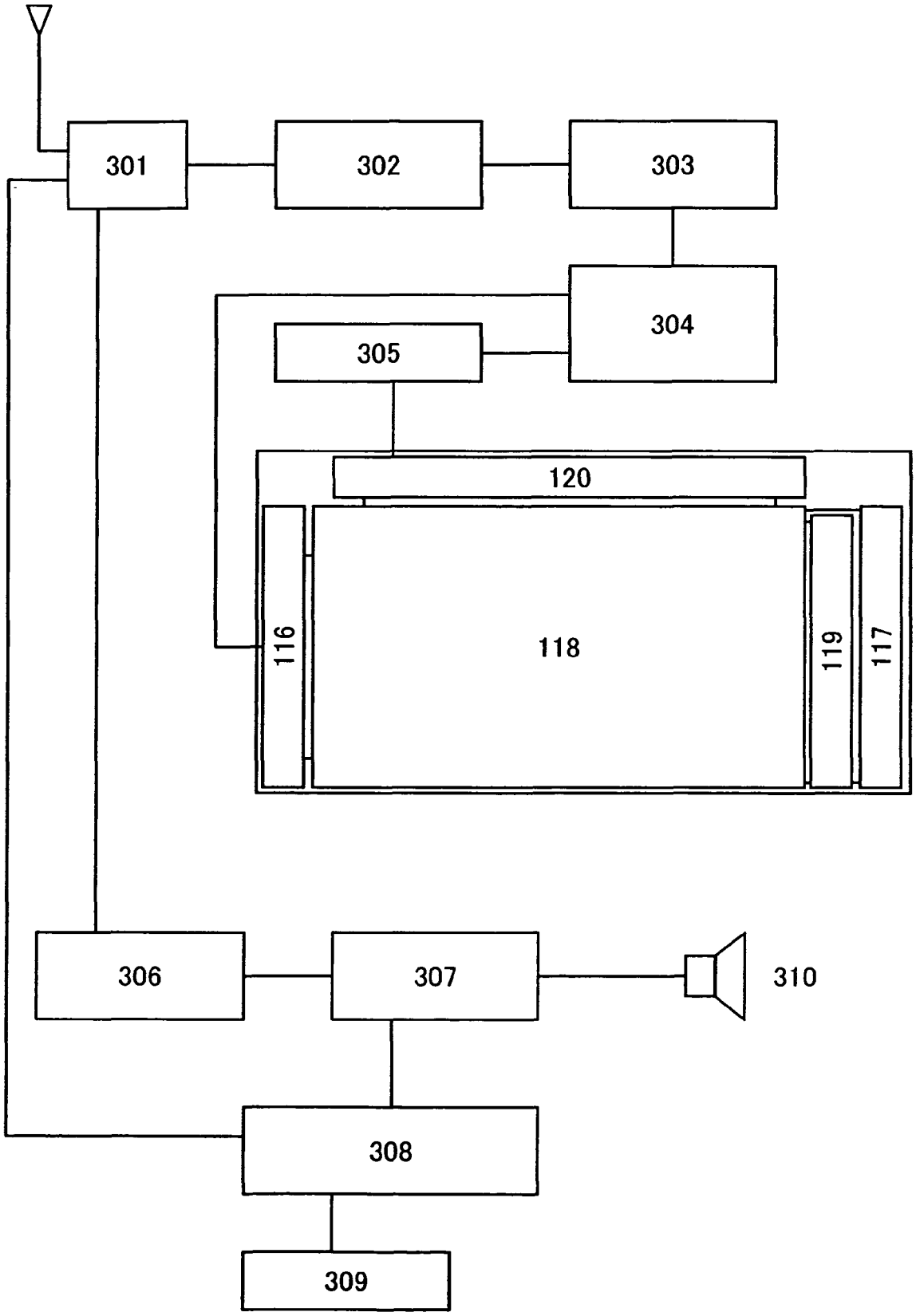
FIG. 6 is a view of an electronic device in accordance with Embodiment 4.

FIG. 6 is a block diagram showing the main configuration of a television set. A transmission/reception circuit 301 receives video signals and audio signals. A video signal is processed by a video signal amplifier circuit 302, a video signal processing circuit 303 which converts a signal output from the video signal amplifier circuit 302 into a color signal corresponding to each color of red, green and blue, and a control circuit 304 which converts the converted signal into a signal which meets the input specification of the driver ICs. The control circuit 304 outputs signals to each of the scan line side and the signal line side. In the case of performing a digital drive, a structure may be employed where the signal dividing circuit 305 is provided on the signal line side so that an input digital signal is divided into m signals before being supplied to the pixel portion.

Among the signals received by the transmission/reception circuit 301, audio signals are transmitted to an audio signal amplifier circuit 306, and an output signal thereof is supplied to a speaker 310 through an audio signal processing circuit 307. A control circuit 308 receives control data on the receiving station (reception frequency) or sound volume from an input portion 309 and transmits signals to the transmission/reception circuit 301 and the audio signal processing circuit 307.

Figure 7A:
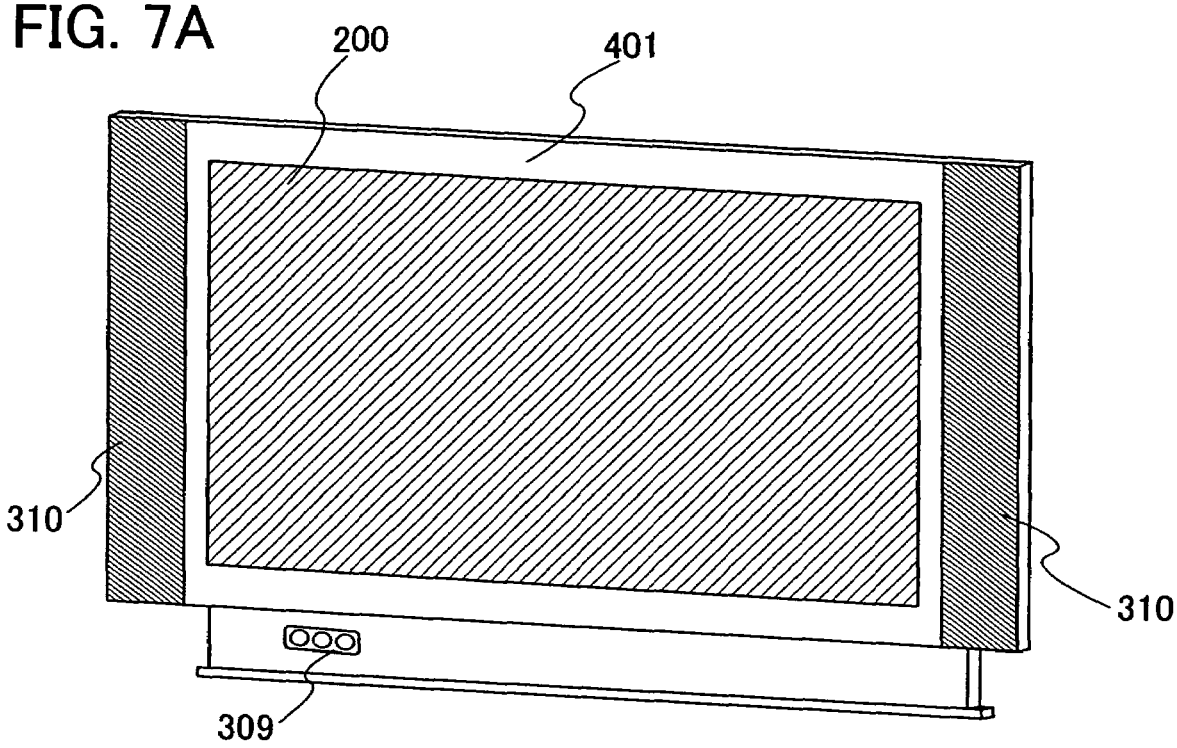
FIGS. 7A and 7B are views of electronic devices in accordance with Embodiment 4.

By incorporating the display module in a housing 401 as shown in FIG. 7A, a television set can be completed. The display module forms a display panel 200. In addition, the speakers 310 and the input portion 309 are provided as appropriate.

Figure 7B:
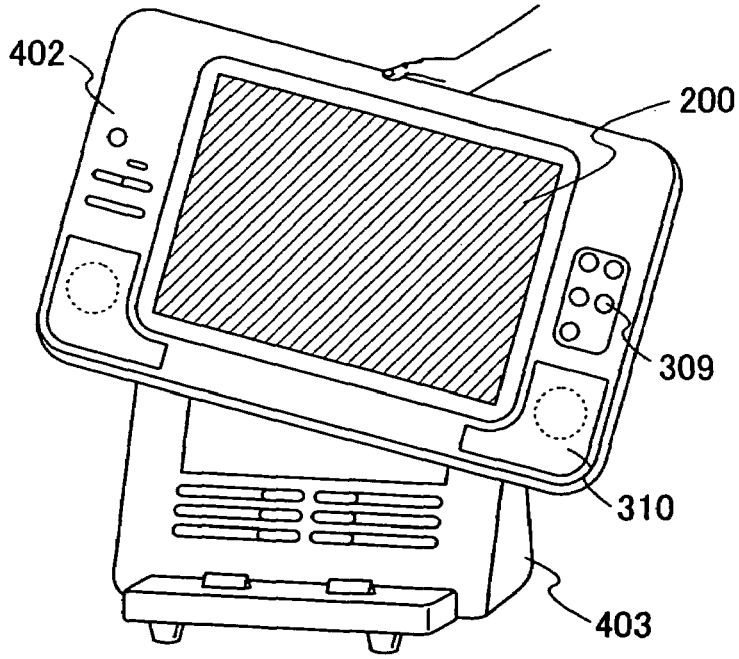

FIG. 7B shows a television set having a portable display which can be used wirelessly. A housing 402 incorporates a battery and a signal receiver, and the battery drives the display panel 200 and the speaker 310. The battery can be repeatedly charged with a battery charger 403. In addition, the battery charger 403 can transmit and receive video signals, and the video signals can be transmitted to the signal receiver of the display. The housing 402 is controlled by the input portion 309. The device shown in FIG. 7B can also transmit signals from the housing 402 to the battery charger 403 by operating the input portion 309; therefore, it can also be called a video/audio two-way communication device. In addition, the device can also perform communication control of other electronic devices by operating the input portion 309 such that signals are transmitted from the housing 402 to the battery charger 403 and the other electronic devices receive signals that the battery charger 403 can transmit. Therefore, the device can also be called a general-purpose remote control device. The invention can be applied to the display panel 200.

By applying the structure in accordance with the invention to the television sets shown in FIGS. 5, 6, 7A and 7B, on/off potentials applied to the gate electrode of the driving transistor in the pixel portion can be set separately from the potential of the data line. Therefore, the maximum potential amplitude of the data line can be set small. Accordingly, a display device whose power consumption is significantly suppressed can be provided, and also a product device whose power consumption is significantly suppressed can be provided to customers.

Needless to say, the invention is not limited to television sets, and can be applied to various objects, in particular, large-area display media such as information display boards at the train station or airport and advertisement display boards on the street as well as monitors of personal computers.

Figure 8A:
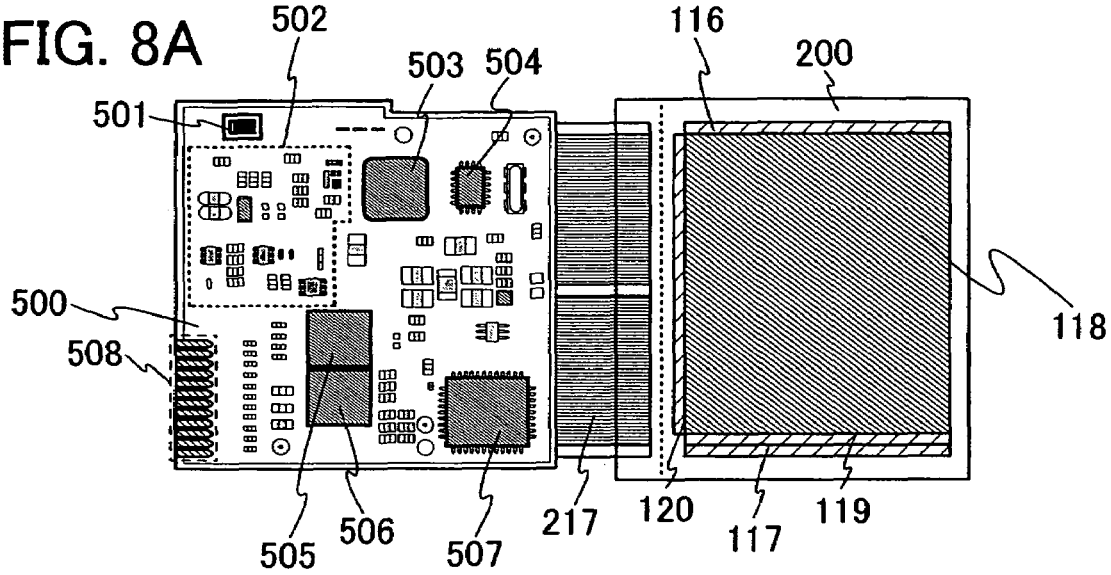
FIGS. 8A and 8B are views of an electronic device in accordance with Embodiment 4.

FIG. 8A shows a display module which combines the display panel 200 and a circuit board 500. The display panel 200 includes the pixel portion 118 where a plurality of pixels are arranged, the first scan line driver circuit 116, the second scan line driver circuit 117, and the signal line driver circuit 120 for supplying video signals to selected pixels.

The circuit board 500 is provided with a controller 504, a microprocessor (MPU) 503, a memory 506, a power supply circuit 507, an audio signal processing circuit 505, a transmission/reception circuit 502, and the like. The circuit board 500 and the display panel 200 are connected to each other with a flexible wiring board (FPC) 217. The flexible wiring board 217 may be provided with a storage capacitor, a buffer circuit, and the like in order to prevent noise interference on the power supply voltage or signals and also prevent signal rise delay. The controller 504, the audio signal processing circuit 505, the memory 506, the microprocessor 503, the power supply circuit 507, and the like may be mounted on the display panel 200 by a COG (Chip On Glass) method. Using the COG method can reduce the scale of the circuit board 500.

Various control signals are input/output through an interface 508 provided on the circuit board 500. In addition, the circuit board 500 is provided with an antenna port 501 for transmitting/receiving signals to/from an antenna.

Figure 8B:
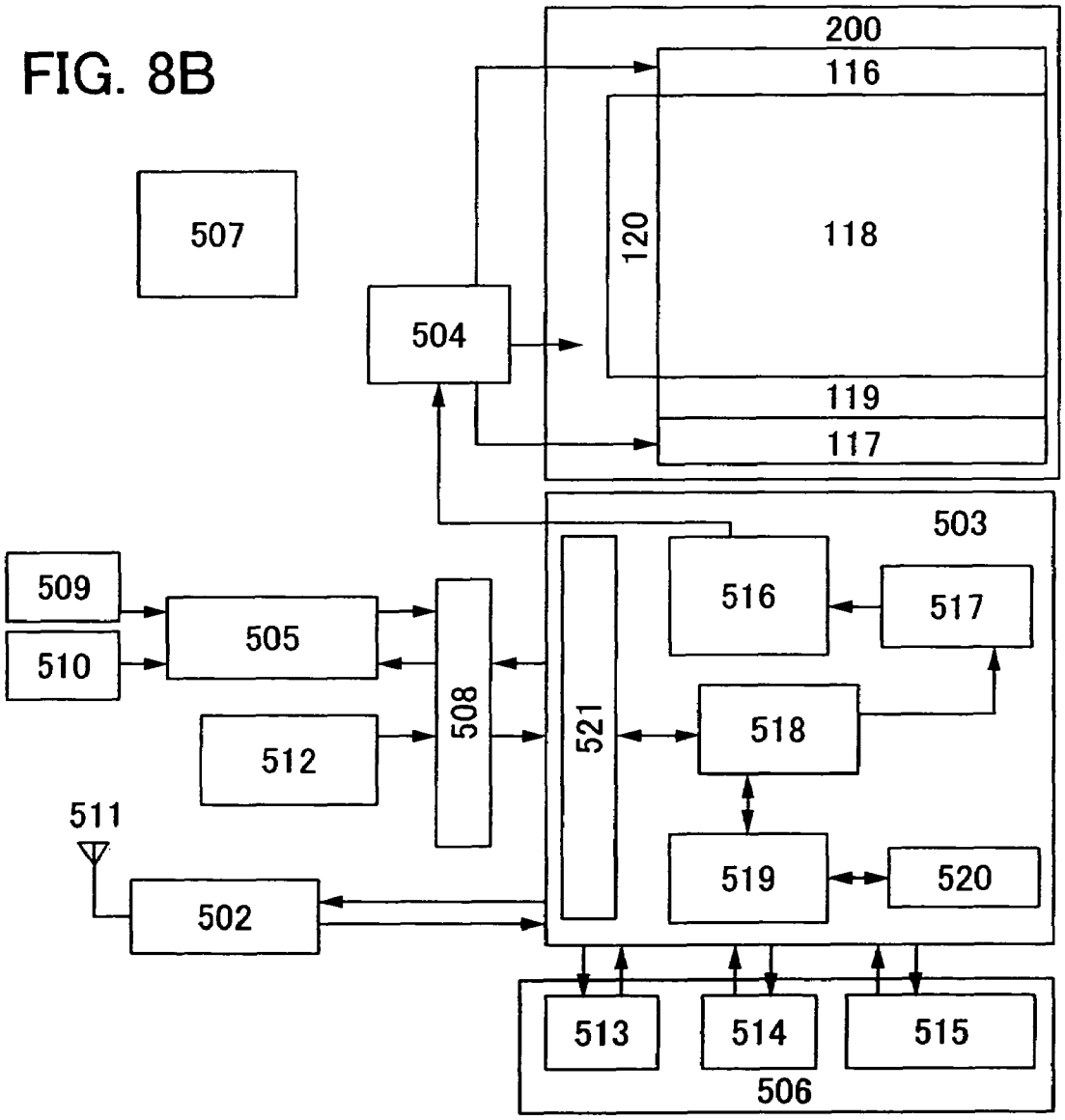

FIG. 8B shows a block diagram of the display module shown in FIG. 8A. This display module includes a memory 506 which includes a VRAM 513, a DRAM 514, a flash memory 515, and the like. The VRAM 513 stores image data to be displayed on the panel, the DRAM 514 stores image data or audio data, and the flash memory 515 stores various programs.

The power supply circuit 507 supplies power to operate the display panel 200, the controller 504, the microprocessor 503, the audio signal processing circuit 505, the memory 506, and the transmission/reception circuit 502. Depending on the specification of the panel, the power supply circuit 507 may be provided with a current source.

The microprocessor 503 includes a control signal generating circuit 516, a decoder 517, a register 518, an arithmetic circuit 519, a RAM 520, and an interface 521 of the microprocessor 503. Various signals which are input to the microprocessor 503 through the interface 521 are once stored in the register 518, and then input to the arithmetic circuit 519, the decoder 517, and the like. The arithmetic circuit 519 performs arithmetic operation based on the input signal and specifies an address to send each instruction. Meanwhile, signals input to the decoder 517 are decoded and input to the control signal generating circuit 516. The control signal generating circuit 516 generates signals containing various instructions based on the input signals and transmits the signals to the address specified by the arithmetic circuit 519, i.e., the memory 506, the transmission/reception circuit 502, the audio signal processing circuit 505, the controller 504, and the like.

Each of the memory 506, the transmission/reception circuit 502, the audio signal processing circuit 505, and the controller 504 operates in accordance with an instruction received. The operation is briefly described below.

Signals input from an input means 512 are transmitted to the microprocessor 503 mounted on the circuit board 500 through the interface 508. The control signal generation circuit 516 converts image data stored in the VRAM 513 into a predetermined format in accordance with the signals transmitted from the input means 512 such as a pointing device or a keyboard, and then transmits the data to the controller 504.

The controller 504 processes signals containing image data which are transmitted from the microprocessor 503 in accordance with the specifications of the panel, and then supplies the signals to the display panel 200. In addition, the controller 504 generates Hsync signals, Vsync signals, clock signals CLK, AC voltage (AC Cont), and switching signals L/R based on the power supply voltage input from the power supply circuit 507 and various signals input from the microprocessor 503, and supplies them to the display panel 200.

The transmission/reception circuit 502 processes signals which are transmitted and received as electromagnetic waves at an antenna 511, and specifically includes high frequency circuits such as an isolator, a bandpass filter, a VCO (Voltage Controlled Oscillator), an LPF (Low Pass Filter), a coupler, and a balun. Among signals which are transmitted to and received from the transmission/reception circuit 502, signals containing audio data are transmitted to the audio signal processing circuit 505 in accordance with an instruction from the microprocessor 503.

The signals containing audio data which are transmitted in accordance with the instruction from the microprocessor 503 are demodulated into audio signals in the audio signal processing circuit 505 and then transmitted to a speaker 510. Audio signals transmitted from a microphone 509 are modulated in the audio signal processing circuit 505, and then transmitted to the transmission/reception circuit 502 in accordance with an instruction from the microprocessor 503.

The controller 504, the microprocessor 503, the power supply circuit 507, the audio signal processing circuit 505, and the memory 506 can be integrated as a package of this embodiment. This embodiment can be applied to any circuits except high frequency circuits such as an isolator, a bandpass filter, a VCO (Voltage Controlled Oscillator), an LPF (Low Pass Filter), a coupler, and a balun.

Figure 9:
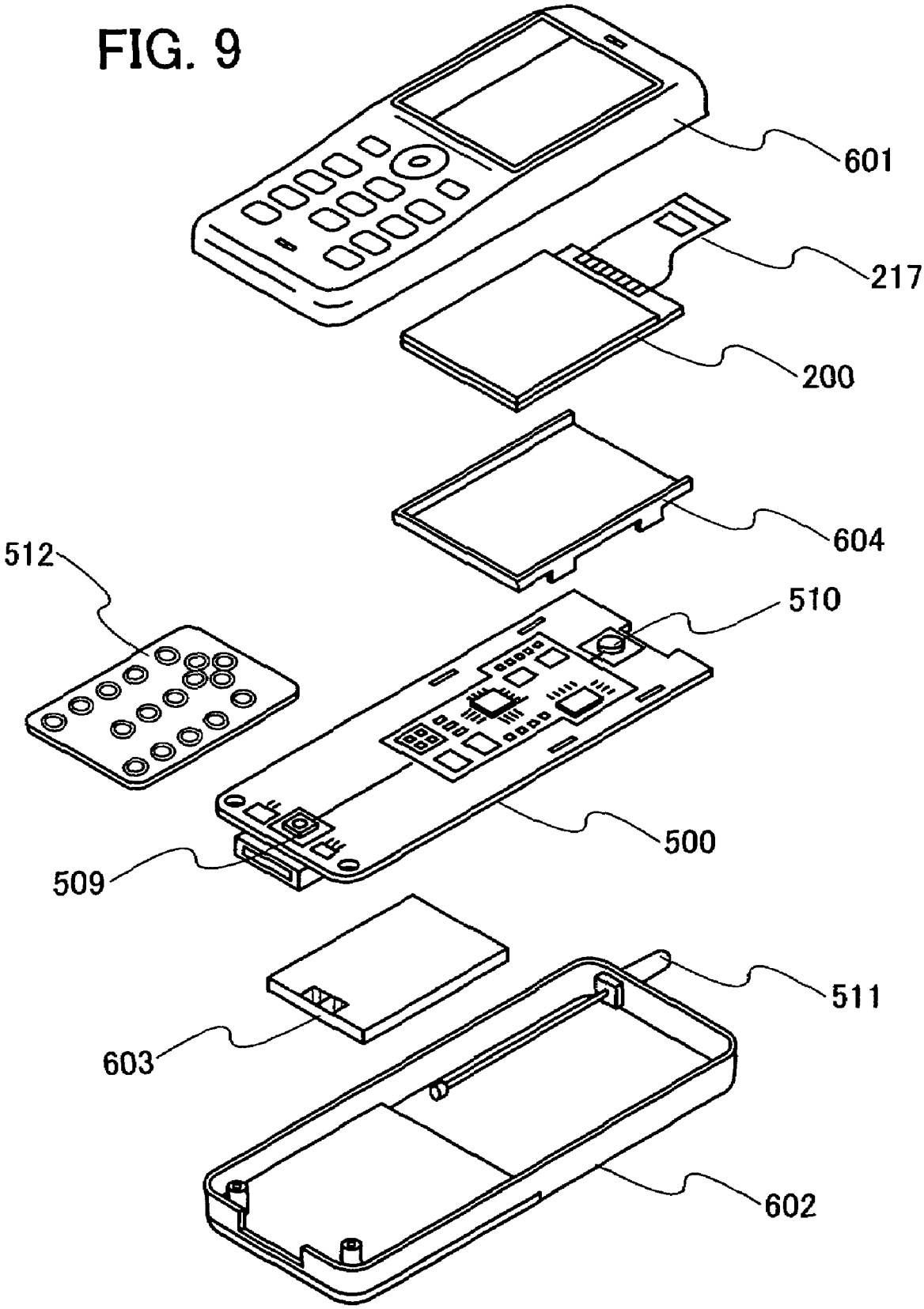
FIG. 9 is a view of an electronic device in accordance with Embodiment 4.

FIG. 9 shows one mode of a mobile phone including the display module shown in FIGS. 8A and 8B. The display panel 200 can be incorporated into a housing 604 in a freely detachable manner. The shape and size of the housing 604 can be changed as appropriate in accordance with the size of the display panel 200. The housing 604 to which the display panel 200 is fixed is fit into the circuit board 500 so as to be assembled as a module.

The display panel 200 is connected to the circuit board 500 through the flexible wiring board 217. On the circuit board 500, the speaker 510, the microphone 509, and the like are mounted in addition to the signal processing circuits including the transmission/reception circuit, the microprocessor, the controller, and the like. Such display module is combined with the input means 512, a battery 603, and the antenna 511, and incorporated into housings 601 and 602. A pixel portion of the display panel 200 is disposed so that it can be seen from an open window formed in the housing 601.

The mobile phone in accordance with this embodiment can be changed into various modes in accordance with functions or applications. For example, the mobile phone can have a structure with a plurality of display panels, or a structure where housings are divided into a plurality of sections as appropriate so that the mobile phone can be opened or folded with a hinge.

In the mobile phone in FIG. 9, the display panel 200 has a matrix arrangement of pixels similar to that described in Embodiment Mode. In the display panel, on/off potentials applied to the gate electrode of the driving transistor in the pixel can be set separately from the potential of the data line. Therefore, the maximum potential amplitude of the data line can be set small. Accordingly, power consumption can be drastically reduced. Such features can drastically reduce the number or scale of the power supply circuits in the mobile phone; therefore, reduction in size and weight of the housing 601 can be achieved. Since the mobile phone in accordance with the invention can achieve low power consumption, downsizing, and lightweight, products with improved portability can be provided to customers.

Figure 10A:
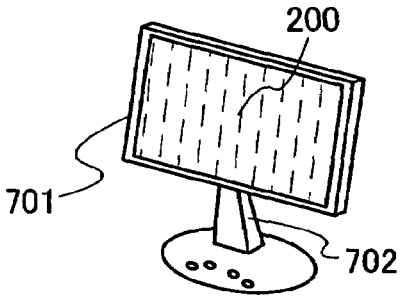
FIGS. 10A to 10E are views of electronic devices in accordance with Embodiment 4.

FIG. 10A shows a television set which includes a housing 701, a support base 702, a display panel 200, and the like. In this television set, the display panel 200 has a matrix arrangement of pixels similar to that described in Embodiment Mode. In the display panel, on/off potentials applied to the gate electrode of the driving transistor in the pixel can be set separately from the potential of the data line. Therefore, the maximum potential amplitude of the data line can be set small. Accordingly, power consumption can be drastically reduced. Such features can drastically reduce the number or scale of the power supply circuits in the television set; therefore, reduction in size and weight of the housing 701 can be achieved. Since the television set in accordance with the invention can achieve low power consumption, downsizing, and lightweight, products suitable for living environments can be provided to customers.

Figure 10B:
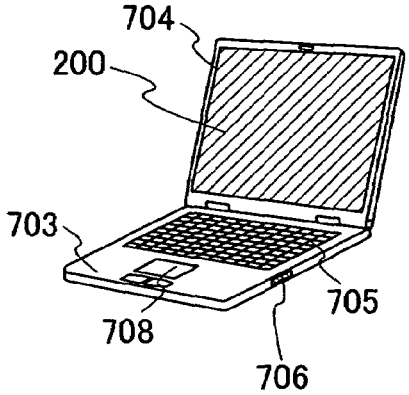

FIG. 10B shows a computer which includes a main body 703, a housing 704, a display panel 200, a keyboard 705, an external connection port 706, a pointing device 708, and the like. In this computer, the display panel 200 has a matrix arrangement of pixels similar to that described in Embodiment Mode. In the display panel, on/off potentials applied to the gate electrode of the driving transistor in the pixel can be set separately from the potential of the data line. Therefore, the maximum potential amplitude of the data line can be set small. Accordingly, power consumption can be drastically reduced. Such features can drastically reduce the number or scale of the power supply circuits in the computer; therefore, reduction in size and weight of the main body 703 and the housing 704 can be achieved. Since the computer in accordance with the invention can achieve low power consumption, downsizing, and lightweight, highly convenient products can be provided to customers.

Figure 10C:
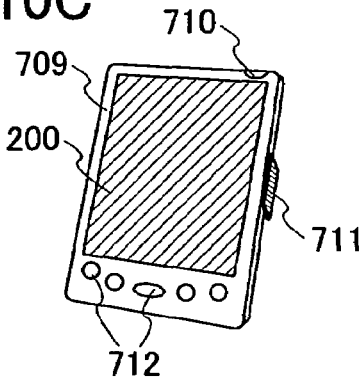

FIG. 10C shows a portable computer which includes a main body 709, a display panel 200, a switch 710, operating keys 712, an infrared port 711, and the like. In this portable computer, the display panel 200 has a matrix arrangement of pixels similar to that described in Embodiment Mode. In the display panel, on/off potentials applied to the gate electrode of the driving transistor in the pixel can be set separately from the potential of the data line. Therefore, the maximum potential amplitude of the data line can be set small. Accordingly, power consumption can be drastically reduced. Such features can drastically reduce the number or scale of the power supply circuits in the portable computer; therefore, reduction in size and weight of the main body 709 can be achieved. Since the portable computer in accordance with the invention can achieve low power consumption, downsizing, and lightweight, highly convenient products can be provided to customers.

Figure 10D:
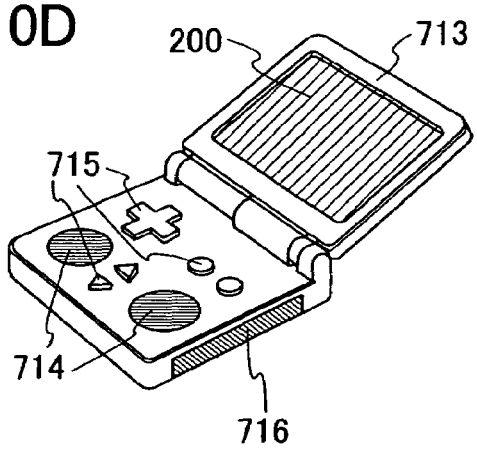

FIG. 10D shows a portable game machine which includes a housing 713, a display panel 200, speaker portions 714, operating keys 715, a storage medium insert portion 716, and the like. In this portable game machine, the display panel 200 has a matrix arrangement of pixels similar to that described in Embodiment Mode. In the display panel, on/off potentials applied to the gate electrode of the driving transistor in the pixel can be set separately from the potential of the data line. Therefore, the maximum potential amplitude of the data line can be set small. Accordingly, power consumption can be drastically reduced. Such features can drastically reduce the number or scale of the power supply circuits in the portable game machine; therefore, reduction in size and weight of the housing 713 can be achieved. Since the portable game machine in accordance with the invention can achieve low power consumption, downsizing, and lightweight, highly convenient products can be provided to customers.

Figure 10E:
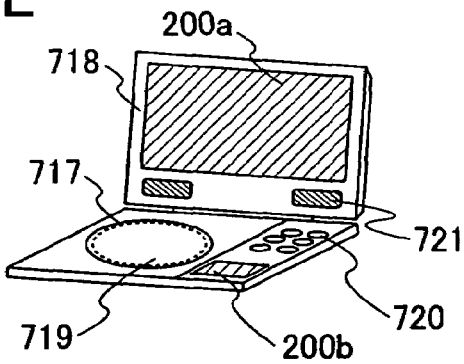
Figure 11A:
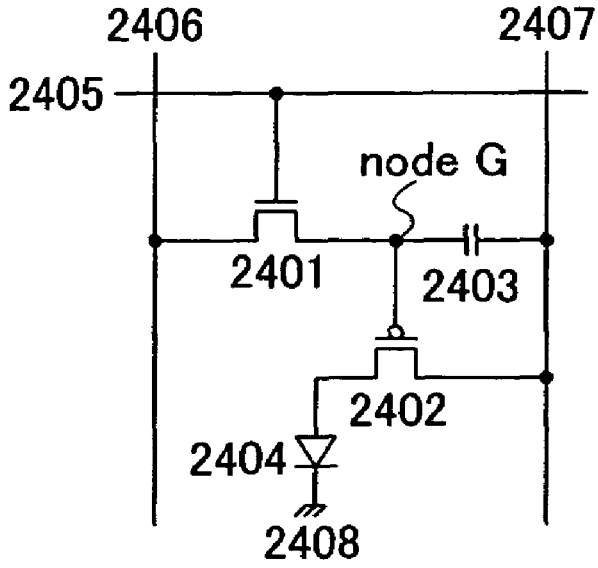
FIGS. 11A and 11B show examples of a conventional art.
Figure 11B:
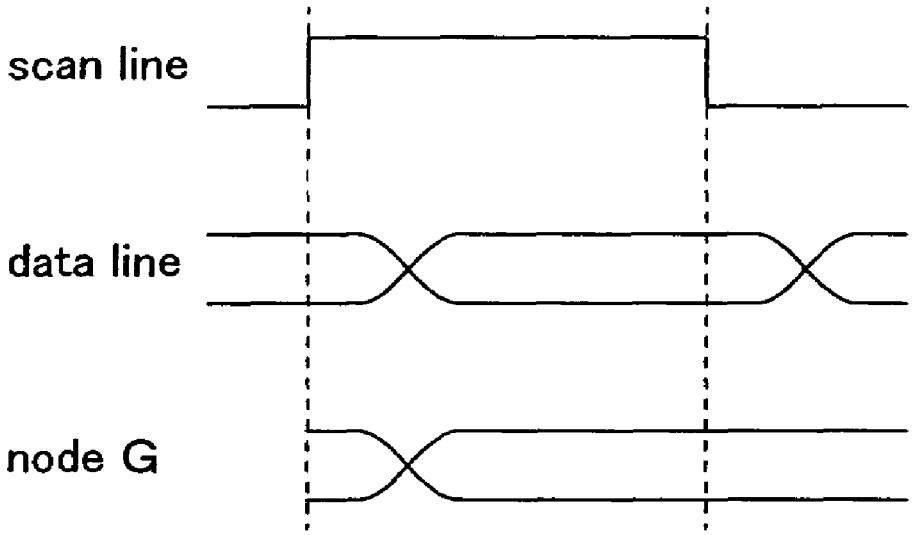
PRIOR ART FIG. 11B

FIG. 10E shows a portable image reproducing device provided with a recording medium (specifically, a DVD player), which includes a main body 717, a housing 718, a display panel 200*a*, a display panel 200*b*, a storage medium (e.g., DVD) reading portion 719, operating keys 720, a speaker portion 721, and the like. The display panel 200*a* mainly displays image data, while the display panel 200*b* mainly displays text data. In this image reproducing device, the display panel 200*a* and the display panel 200*b* have a matrix arrangement of pixels similar to that described in Embodiment Mode. In the display panels, on/off potentials applied to the gate electrode of the driving transistor in the pixel can be set separately from the potential of the data line. Therefore, the maximum potential amplitude of the data line can be set small. Accordingly, power consumption can be drastically reduced. Such features can drastically reduce the number or scale of the power supply circuits in the image reproducing device; therefore, reduction in size and weight of the main body 717 and the housing 718 can be achieved. Since the image reproducing device in accordance with the invention can achieve low power consumption, downsizing, and lightweight, highly convenient products can be provided to customers.

The display panels used for the above electronic devices can be formed using not only glass substrates, but also heat-resistant plastic substrates in accordance with the size, strength, or intended use. Accordingly, further reduction in weight can be achieved.

Note that the examples shown in this embodiment are only illustrative, and therefore, the invention is not limited to these applications.

This embodiment can be freely combined with the structures in Embodiments 1 to 3.

The present application is based on Japanese Priority application No. 2006-005592 filed on Jan. 13, 2006 with the Japanese Patent Office, the entire contents of which are hereby incorporated by reference.

What is claimed is:

1. A display device comprising:

a power supply line;

a first scan line driver circuit electrically connected to one end of a first scan line;

a second scan line driver circuit electrically connected to one end of a second scan line;

a current supply line;

a light-emitting element;

a scan line auxiliary circuit electrically connected to the other end of the first scan line, the scan line auxiliary circuit including at least one switching element;

a driving transistor electrically connected in series between the current supply line and the light-emitting element;

a storage capacitor, one electrode of which is electrically connected to a gate electrode of the driving transistor, and the other electrode of which is electrically connected to the current supply line;

a reset transistor, a gate electrode of which is electrically connected to the first scan line, and one of a source electrode and a drain electrode of which is electrically connected to the current supply line;

a switch transistor having a gate electrode electrically connected to the second scan line, the switch transistor being electrically connected between the other of the source electrode and the drain electrode of the reset transistor and one electrode of the storage capacitor; and a selection transistor having a gate electrode electrically connected to a data line, the selection transistor being electrically connected in series between the switch transistor and the first scan line, wherein the first scan line is configured to being electrically connected to the power supply line through the switching element, and a gate potential of the driving transistor is set equal to a potential of the power supply line, by controlling the switching element with a signal potential of the first scan line and a signal potential of the second scan line which is supplied from the second scan line driver circuit.

2. The display device according to claim 1, wherein the signal potential supplied from the first scan line driver circuit is equal to the potential of the power supply line.

3. A display device comprising:

a power supply line;

a first scan line driver circuit electrically connected to one end of a first scan line;

a second scan line driver circuit electrically connected one end of a second scan line;

a first transistor;

a second transistor; and an inverter, wherein the other end of the first scan line is electrically connected to an input terminal of the inverter;

wherein a gate electrode of the first transistor is electrically connected to an output terminal of the inverter;

wherein one of a source electrode and a drain electrode of the first transistor is electrically connected to the other end of the first scan line;

wherein a gate electrode of the second transistor is electrically connected to one end of the second scan line or the second scan line driver circuit;

wherein one of a source electrode and a drain electrode of the second transistor is electrically connected to the other of the source electrode and the drain electrode of the first transistor; and wherein the other of the source electrode and the drain electrode of the second transistor is electrically connected to the power supply line.

4. The display device according to claim 3, wherein a signal potential supplied from the first scan line driver circuit is equal to a potential of the power supply line.

5. A display device comprising:

a power supply line;

a scan line;

a scan line driver circuit electrically connected to one end of the scan line;

a transistor; and an inverter, wherein the other end of the scan line is electrically connected to an input terminal of the inverter;

wherein a gate electrode of the transistor is electrically connected to an output terminal of the inverter;

wherein one of a source electrode and a drain electrode of the transistor is electrically connected to the other end of the scan line; and wherein the other of the source electrode and the drain electrode of the transistor is electrically connected to the power supply line.

6. The display device according to claim 5, further comprising a light emitting element and a driving transistor, wherein conductivity of the transistor is different from that of the driving transistor.

7. The display device according to claim 5, wherein a signal potential supplied from the scan line driver circuit is equal to a potential of the power supply line.

8. A display device comprising:

a power supply line;

a scan line;

a scan line driver circuit electrically connected to one end of the scan line; and a scan line auxiliary circuit electrically connected to the other end of the scan line, the scan line auxiliary circuit including a transistor and an inverter;

wherein the other end of the scan line is electrically connected to an input terminal of the inverter;

wherein a gate electrode of the transistor is electrically connected to an output terminal of the inverter;

wherein one of a source electrode and a drain electrode of the transistor is electrically connected to the other end of the scan line; and wherein the other of the source electrode and the drain electrode of the transistor is electrically connected to the power supply line.

9. The display device according to claim 8, further comprising a light emitting element and a driving transistor, wherein conductivity of the transistor is different from that of the driving transistor.

10. The display device according to claim 8, wherein a signal potential supplied from the scan line driver circuit is equal to a potential of the power supply line.

* * * * *